United States Patent [19]

Higuera et al.

[11] Patent Number: 4,966,423

[45] Date of Patent: Oct. 30, 1990

[54] CABINET DRAWER INTERLOCKING APPARATUS

[75] Inventors: Bernard A. Higuera, Alhambra; Miguel A. Arreola, Ontario, both of Calif.

[73] Assignee: Russ Bassett Company, Whittier, Calif.

[21] Appl. No.: 454,761

[22] Filed: Dec. 21, 1989

[51] Int. Cl.[5] ..... E05C 7/06

[52] U.S. Cl. ..... 312/221; 312/219

[58] Field of Search ..... 312/216, 217, 219, 221

[56] References Cited

U.S. PATENT DOCUMENTS 3,936,108 2/1976 Chitester ..... 312/219 X
4,355,851 10/1982 Slusser ..... 312/221 X
4,768,844 9/1988 Ludwig ..... 312/219 X
4,838,627 6/1989 Macias ..... 312/341.1
4,889,396 12/1989 Mitchell et al. ..... 312/321 X

*Primary Examiner*—Joseph Falk
*Attorney, Agent, or Firm*—George J. Netter

[57] ABSTRACT

A cabinet drawer interlock to prevent more than one drawer from being opened at one time has an actuator on each drawer which is engaged with a separate sprocket rotor. A number of locking bars arranged in end contacting relation and each bar having a slot. First and second pawls on each rotor are inserted between the ends of a pair of adjacent locking bars and within a locking bar, respectively, when a first drawer is opened rotating the rotor for that drawer. The remaining closed drawers cannot be opened since the associated locking bars contact the pawl ends on attempted rotor rotation.

10 Claims, 4 Drawing Sheets

10
11
12
13
14
15
16
12

51
52
53
54
55
56
58
38
30
30
45
44
46

40
41
43
42
39
38
39
37
36
34
34
35
27
30
22
22
33
29
32
27
28
30
30
22
27
30

CABINET DRAWER INTERLOCKING APPARATUS

BACKGROUND OF THE INVENTION

1. Field of the Invention

The present invention relates generally to filing cabinets having a plurality of drawers which can be selectively extended into the open position, and, more particularly, to interlocking apparatus for such cabinets which automatically locks remaining drawers in the closed position when any one of the drawers is open.

2. Description of the Related Art

A frequently encountered difficulty in the use of cabinets having a number of drawers is that if more than one drawer is in the extended or open position, the entire cabinet may become unstable to the point of tipping over and thereby possibly injuring someone, or, at the least, dumping the drawer contents on the floor. Also, if two adjacent drawers are both attempted to be opened this can result in injury to the fingers by their being pinched between the drawers.

To avoid these difficulties, various drawer interlocks have been proposed operating to prevent the opening of a further drawer after one drawer is in the extended or open position, and yet when all drawers are closed, any one selected drawer may be opened. Although such interlocks have been known in the past, they have not been completely satisfactory in that some are not reliable resulting in jamming or failure to operate after a relatively short use life, while others are prohibitively expensive to manufacture in that they require a number of precisely machined parts resulting in an ultimate cost to the consumer which is unacceptably high. Still other known interlocking apparatus has been found to fail in occasionally allowing more than one drawer to open or sometimes resulting in none of the drawers being capable of being opened.

SUMMARY OF THE DISCLOSURE

In accordance with the practice of this invention, there is secured to each side wall of each drawer of a multi-drawer cabinet an elongated guide extending parallel to the direction of movement of the drawer from its open to closed position. Each guide interfits with a track affixed to the opposite inside wall of the cabinet and serves as both a support for the drawer and a means along which the drawer moves during opening and closing. Extending vertically away from an upper surface of a guide is a locking actuator, the actuators for all the drawers lying in a single vertical line when all of the drawers are in the closed position.

At a point directly opposite the line of actuators there is provided on the interior surface of the cabinet wall, drawer interlock apparatus which coacts with the various actuators, in a way to be described, for preventing the opening of a given drawer when any one of the other actuators is removed from operative engagement with the locking apparatus. More particularly, a plurality of identical rotor devices (one for each drawer) are located on the locking apparatus at points, respectively, directly opposite to and engageable with an actuator as it moves there past. The rotor device includes a rotatable single cylinder having a generally V-shaped sprocket which, when free to rotate, receives the actuator therein and is rotated by the actuator to engage and move the associated sprocket arm in the same direction as that movement of the actuator.

Between each adjacent pair of rotor devices there is arranged a locking bar resulting in a plurality of identical locking bars in end contacting relation and constrained to move along the longitudinal axis of the locking bars.

First and second pawls are fixed onto a side surface of each rotatable locking means opposite to that surface carrying the V-shaped sprocket and include portions which, upon proper rotor rotation move between the ends of two adjacent locking bars and within a slot in a locking bar, respectively. This rotation results in the two adjacent locking bars being separated which simultaneously moves all the locking bars above and below the open drawer for a purpose to be described.

With the described apparatus assembled on a cabinet having a number of drawers and assuming all the drawers are in the closed position, at this time the actuator of each is received within the V-shaped sprocket of the immediately adjacent rotor. When any one of the drawers is opened, the actuator forces against one of the arms of the sprocket causing the rotor to rotate which inserts its two pawls between adjacent connecting arms and within a locking bar slot, respectively, forcing the bars apart a prescribed amount. The vertical movement of the locking bars causes them to be located in obstructing rotation of the sprocket rotors and, therefore, those drawer actuators are locked to the sprocket preventing all remaining drawers from opening. Accordingly, the remaining closed drawers are all locked in this position as long as the first drawer remains open.

When the open drawer is returned to its closed position, then its drawer actuator engages the V-shaped sprocket rotating it to its closed position which removes the pawls from engagement with the locking bars allowing any other drawer (or the first drawer again) to be opened in the described manner.

A cabinet lock is provided which when in the locked mode moves all of the drawer locking bars as a unit placing them in obstructing relation to the pawls preventing them from rotating, and, in that way, prevents any of the drawers from being pulled to the open position.

DESCRIPTION OF A PREFERRED EMBODIMENT

Figures 1, 2, 3:
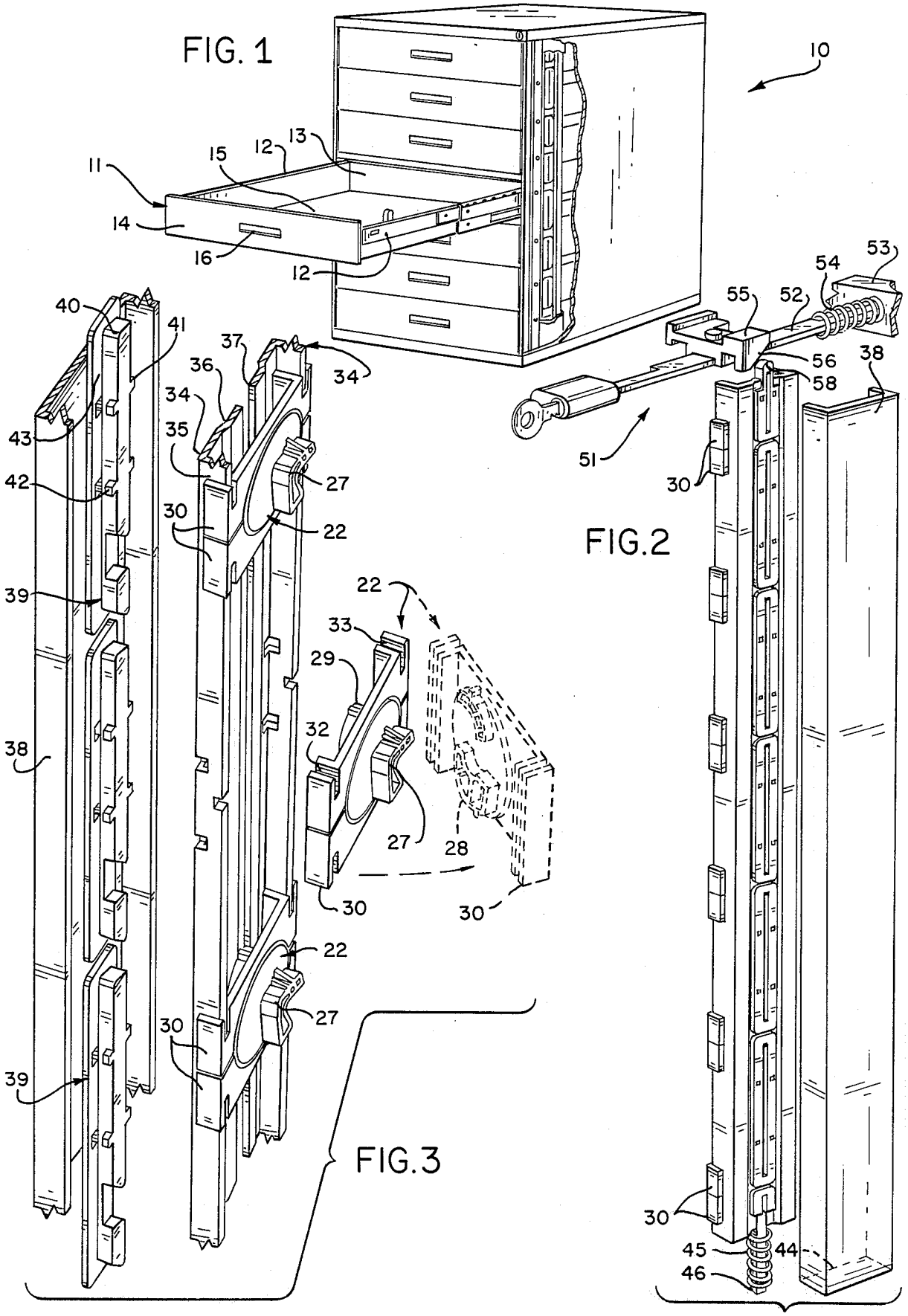
FIG. 1 is a perspective, partially fragmentary view showing a file cabinet with a number of drawers therein and the interlock apparatus of this invention.
FIG. 2 shows the interlock apparatus in its entirety remove the cabinet of FIG. 1.
FIG. 3 is a perspective view of the apparatus of FIG. 2 shown with its various parts in exploded relation.

Turning now to the drawings and particularly FIG. 1, a filing cabinet 10 with which the described drawer interlock apparatus can be advantageously employed is seen to include a plurality of drawers 11 which can be selectively withdrawn to the open position, or moved into the closed position where the drawers are stored within the cabinet housing. When all of the drawers are stored within the housing, and thus in the closed position, the cabinet is a stable arrangement with its center of gravity located over the cabinet base, and it would be difficult to tip over. However, when several drawers are opened, this would locate the weight of those drawers outwardly of the cabinet base making the weight distribution unstable, and which could, if sufficiently unbalanced, result in the cabinet overturning. Accordingly, it has been found desirable to alleviate this potential problem of unbalance by providing an interlock between the various drawers which only permits a single drawer being in the open position and thereby insuring a stable arrangement with most of the weight at all times remaining over the cabinet base.

Each of the drawers 11 includes two side panels 12, a rear panel 13, a front panel 14, and bottom 15 leaving an open top through which materials can be added to or removed from the drawer. A handle or finger pull 16 located on the front or outer surface of the front panel 14 provides means for manual repositioning of the drawer to either the open or closed condition.

Figure 4:
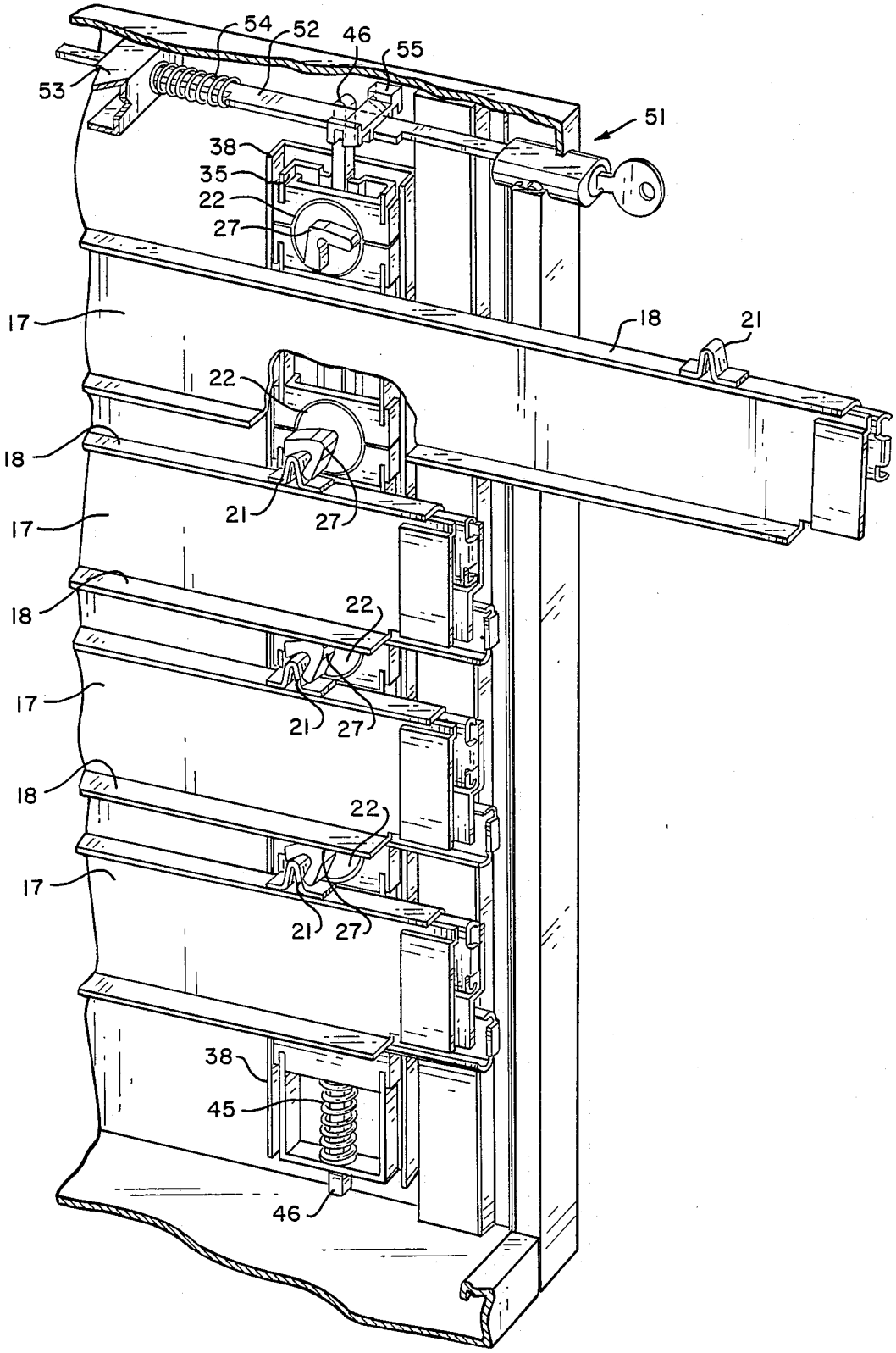
FIG. 4 is a perspective, partially fragmentary view of the interlock apparatus of this invention shown in operative to a number of drawers.
Figure 5:
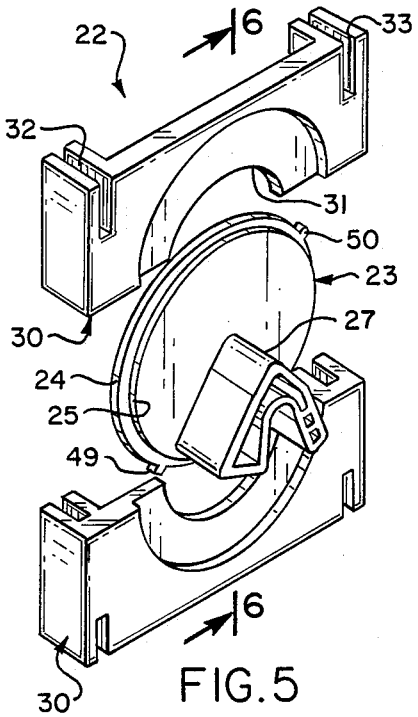
FIG. 5 is a perspective detail of an individual drawer locking means.
Figure 6:
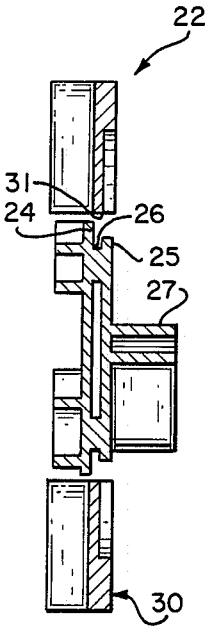
FIG. 6 is a side elevational, sectional view taken along the line 6–6 of FIG. 5.

With reference now simultaneously to FIG. 4, the outer side wall of each drawer has affixed thereto a rail assembly 17 which generally includes rectangular metal parts extending lengthwise of the drawer having a top, generally horizontal, rectangular, edge margin 18 which extends parallel to the direction of drawer movement on opening and closing.

In a way well known in the art, the drawer rail assemblies 17 respectively slide along elongated tracks (not shown) located immediately opposite on the cabinet inner sidewall providing support for the drawers and sliding surfaces and enabling the drawers to be moved in and out of the cabinet.

Disclosure of detailed construction of an excellent rail assembly 17 and associated track for advantageous use with the present invention is to be found in U.S. Letters Pat. No. 4,838,627 dated June 13, 1989 for DRAWER MOUNTING MEANS.

At a point spaced from what is the inner end of each rail assembly 17 and located on the horizontal surface 18, is a generally U-shaped actuator 21 which, as will be more particularly described, cooperates with the interlocking apparatus on opening and closing of a drawer to place the interlocking apparatus in either the locked or unlocked mode, as the case may be. More particularly, the actuator extends vertically upward from the surface 18 terminating in a rounded outer end. The actuator can be secured to the rail assembly surface in any of a number of different conventional ways such as, for example, by spot welding. When the drawers are all closed, the actuators 21 lie along the same generally vertical line, one above the other.

For the ensuing description of the interlocking apparatus details, reference is now made simultaneously to FIGS. 2 through 7. A plurality of identical drawer locking means 22, one for each cabinet drawer, are mounted in a way to be described to an inner wall of the cabinet housing and have parts which lockingly engage the actuator 21 of the immediately adjacent drawer when the drawer is in its fully closed position. When all drawers are closed, each of the drawer locking means 22 is in the released or unlocked mode so that any one of the drawers may be opened. However, as soon as one of the drawers is opened, then all of the remaining drawer locking means are immediately and automatically locked onto their respective actuators 21 preventing any of the remaining drawers from being opened.

Each drawer locking means 22 has a generally disk-like rotor 23 with a first or large diameter part 24 and a second lesser diameter part 25 axially secured to the first part 24 with a circumferential slot 26 therebetween. A generally V-shaped locking sprocket 27 is affixed to the outer major surface of the part 25, and spacer pawls 28 and 29 are secured to the part 24 opposite major surface. The rotor, sprocket and pawls are unitarily related so that rotation of the rotor simultaneously moves the sprocket and spacer pawls.

Figure 7:
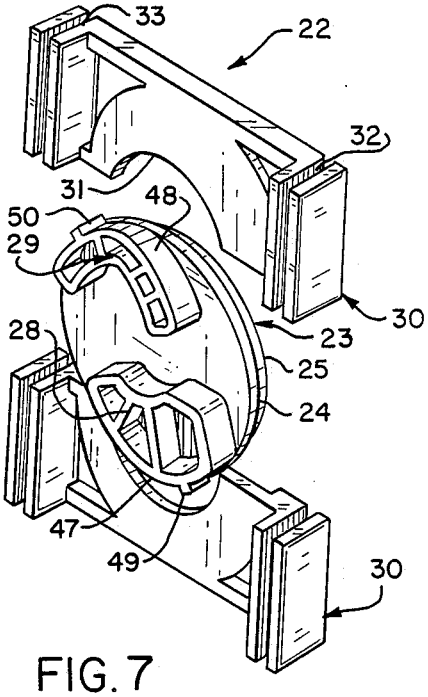
FIG. 7 is a perspective view depicting the back side of FIG. 5.

A pair of identical rotor housing parts 30 are provided each having a generally U-shaped cross-section with circular cut-out center portions 31 which fit into the rotor slot 26. Specifically, the two housing parts 30 are fitted onto opposite sides of the rotor and are of such dimensions that when so mounted they have edge parts that contact one another and secure the rotor therebetween while allowing the rotor to be readily rotated about its central axis. Adjacent the two sides of the housing parts 30 there are provided first and second parallel slots 32 and 33 which open both toward the top and toward the rear (FIG. 7). When two housing parts are assembled with a rotor, the slots 32 and 33 on each side are respectively aligned with each other forming a single straight line slot at each side of the rotor.

Turning now specifically to FIGS. 2 and 3, two generally L-shaped mounting brackets 34 are provided of identical construction each having an end wall 35 and a back wall 36. The back wall has a terminating margin which is offset slightly from its outer surface at 37 (FIG. 3). The pair of brackets 34 are conveniently secured within a channel 38 which is, in turn, mounted (e.g., welded) to the inner wall of the cabinet such that the two offset portion edges 37 are spaced apart and extend vertically parallel to the line of actuators on the drawers when they are closed. The end walls 35 of the pair of such brackets are spaced apart an amount enabling the pair of slots 32 and 33 for each housing part of each drawer locking means to be fitted thereon (FIG. 3). Cutouts at appropriate locations along the end walls 35 interfit with projections (not shown) on the housing part walls defining slots 32 and 33 to precisely and lockingly position each drawer locking means 22 at a level with the drawer with which it is to coact.

For assembly onto the pair of mounting brackets 34, there are provided a number of locking bars 39, one for each drawer, which are of identical construction. More particularly, each such locking bar includes an elongated, rectangular rod 40 having several first and second arms 41 and 42 extending away from each side of the rod. A rectangular contact plate 43 is affixed to an outer major surface of the rod 40 with portions extending outwardly of the rod on all sides. Each of these locking bars is substantially the same in overall length which is also identical to the vertical spacing between adjacent drawers.

In assembly, a sufficient number of locking bars 39 are inserted in the space between two brackets 34 with the rod 40 sliding along the space between the two bracket backwall edges with the arms 41 and 42 on one side of the backwalls 36, and the contact plate 43 is located on the outer side of the backwall 36.

As can be seen best in FIG. 2, at the lower end of the two brackets 34 there is located a base plate 44 with an opening therein through which a spacer rod 46 passes. A helical spring 45 received about the spacer rod provides a resilient contact to the lowermost end of the bottom locking bar 39 as well as all those locking bars above.

All of the locking bars 39 form a set for the different cabinet drawers with contact plates 43 of adjacent locking bars in edge contacting relation, the lowermost being in contact with the spacer rod 45. As already noted briefly, the large diameter rotor part 24 has first and second pawls 28 and 29 fixed to its outer surface (FIG. 7) which lie diametrically opposite one another. The pawls have convexly outwardly facing camming surfaces 47 and 48, respectively, which in a way that will be described cooperate to move and precisely position the locking bars 39 for achieving the locking or unlocking mode, depending upon whether a drawer is in the open position or they are all closed. Limit stop projections 49 and 50 on the pawl camming surfaces 47 and 48, respectively, serve, in a way that will be described, to prevent the rotors 23 from rotating beyond a given maximum.

Figure 8:
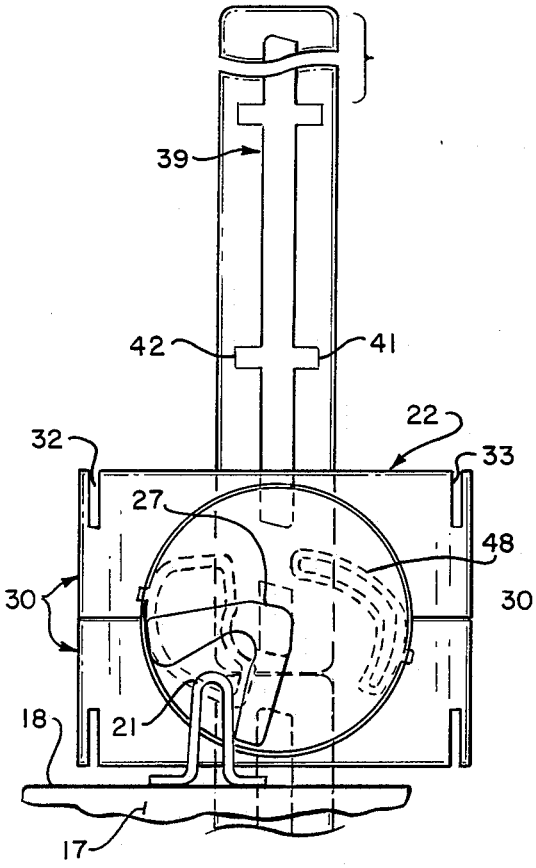
FIGS. 8 and 9 are schematic views of the operation of the drawer locking means of FIG. 5, showing it in the drawer closed and drawer open positions, respectively.
Figure 9:
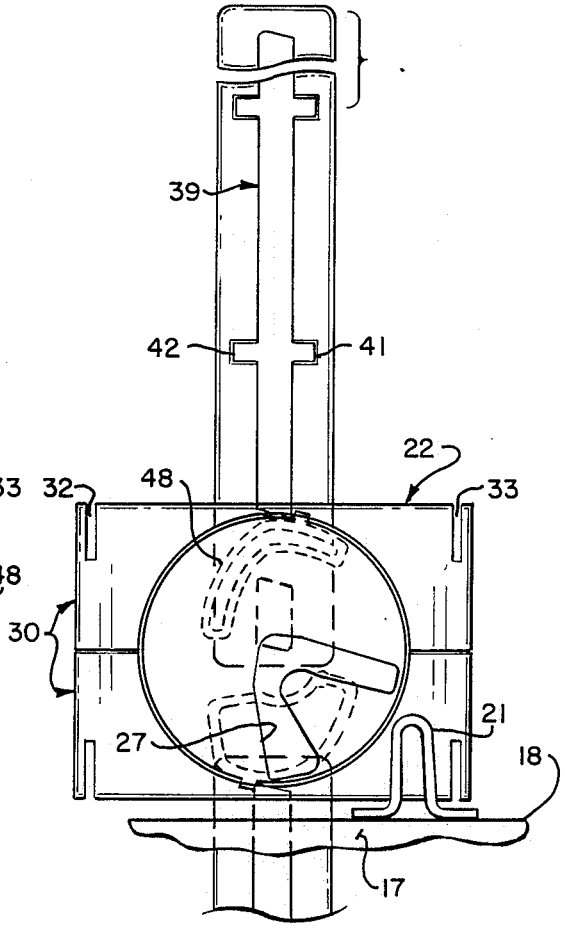

For the following description of the drawer locking means 22 operation, reference is now made to FIGS. 4, 8 and 9. Assuming initially that all of the drawers are closed, the actuators 21 are accordingly all located in the same vertical line and each actuator is received within a V-shaped sprocket 27 as depicted in FIG. 8. Also, at this time the two rotor pawls 28 and 29 are free from obstructing movement of the locking bars 39. The drawer interlocking apparatus is in the unlocked mode for all the drawers with the locking bars resting in end contacting relationship on one another.

When a drawer is opened the actuator 21 on its rail assembly moves to the right rotating the associated V-shaped sprocket 27 from the position shown in FIG. 8 to that shown in FIG. 9. This rotation causes the pawl 28 to be inserted between the ends of the two immediately adjacent rods 40 of locking bars 39. Simultaneously, the pawl 29 moves into a slot 51 formed in the lower end portion of each rod 40 which moves the two adjacent bars 39 apart a given amount. Limit stops 49 and 50 prevent the sprocket from being over-rotated which could prevent reengagement with the actuator on the drawer being closed.

Figure 10:
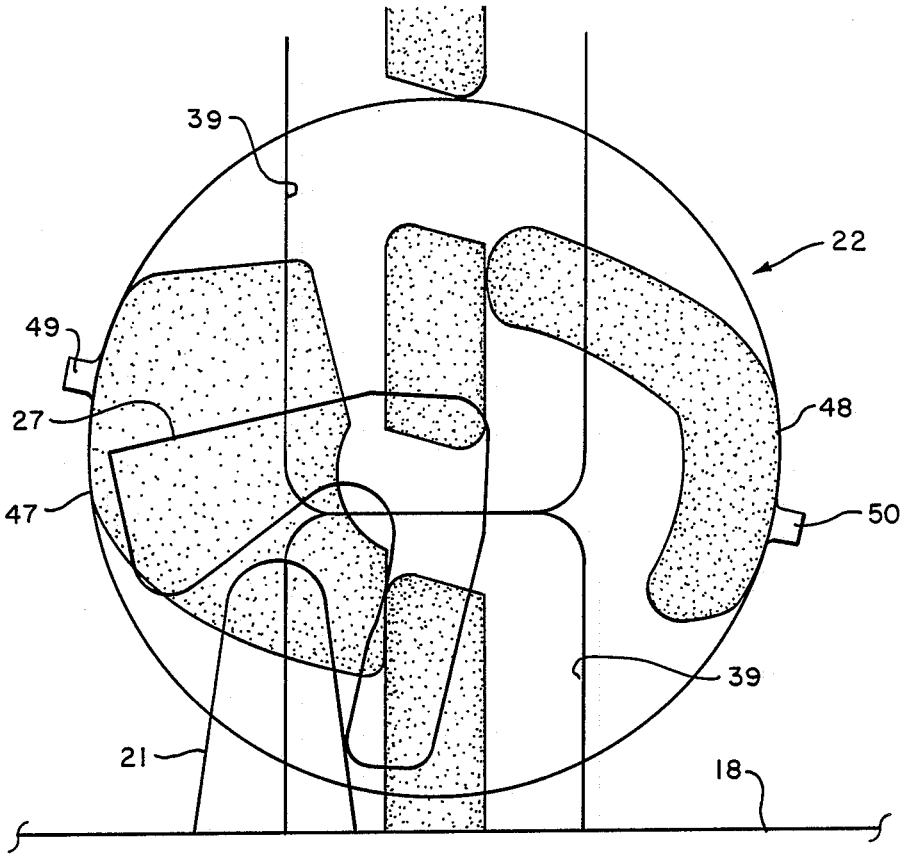
FIG. 10 is an elevational view of a drawer locking means shown in locked position.

FIG. 10 depicts the relative positions of the pawls 28 and 29 for each of the drawer locking means 22 of those drawers remaining in the cabinet after one drawer is opened and located above the open drawer. Because of the vertical upward movement of the bars 39 from the FIG. 8 position none of the rotors 23 for the remaining upper drawers can rotate in the opening direction since the pawl ends are now obstructed by the bars 39. Similarly, those locking bars for drawers below the open drawer have been moved vertically downward as a result of the one drawer being opened which also produces an obstructing relationship between the locking bar rods and the pawls so that all drawers below the open drawer are locked in the closed position.

Return of the opened drawer to the closed position engages the associated sprocket 27 with the actuator 21 moving the sprocket from the FIG. 9 position back to that shown in FIG. 8 with both pawls 28 and 29 withdrawn from engagement with the contacting locking bars. All of the different drawer sprockets and actuators are now in the FIG. 8 position enabling any drawer to be opened.

Figure 11:
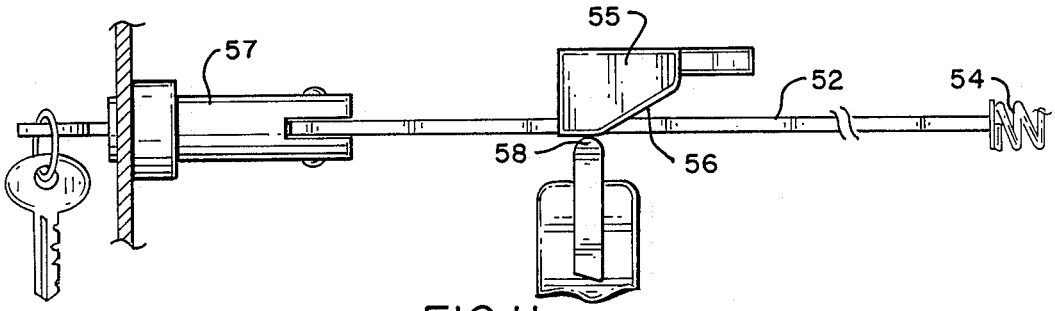
FIG. 11 is a side elevational view of the cabinet lock shown in locked mode.
Figure 12:
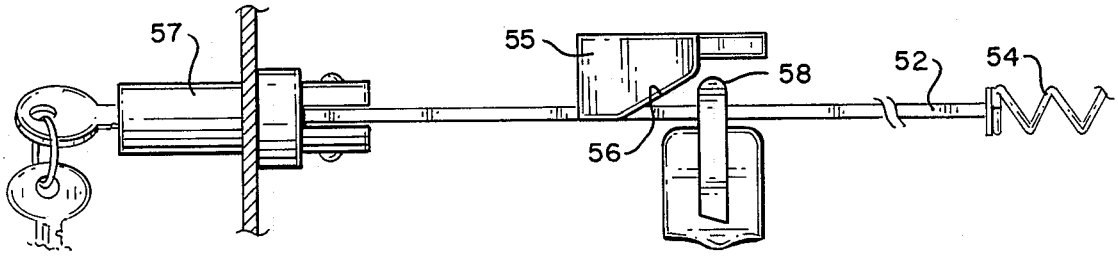
FIG. 12 is a side elevational view of the cabinet lock shown in the unlocked mode.

For the ensuing description of the cabinet drawer lock 51 reference should be made to FIGS. 2, 11 and 12. An elongated plate arm 52 has an end that is slidingly received within a slot within a cross channel 53 and provided with resilient longitudinal movement by a coil spring 54 which acts between the cross channel and a shoulder (not shown) on arm 52. Intermediate the arm 52 ends there is affixed an actuator 55 having a beveled camming surface 56. The outer end of the arm 52 is secured to a key operated locking bolt 57 which is mounted into an opening in the front upper portion of the cabinet.

The locking bar for the uppermost drawer has a rounded upper end 58 which lies in the path of movement of the actuator 55. Specifically, when the locking bolt 57 is in the unlocked mode, the actuator is free from contact with the locking bar rounded part 58 (FIG. 12), and, therefore, the drawers may be opened. On the other hand, when the key is turned to the locked position (FIG. 11) the cam surface 56 forces the entire set of locking bars downwardly so that all the pawls of drawer rotors are obstructed by the locking bar rods from rotating, and, therefore, all drawers are locked into the closed position.

Although the present invention is described in connection with a preferred embodiment, it is to be understood that those skilled in the appertaining art may make modifications that will come within the spirit of this invention and within the ambit of the appended claims.

What is claimed is:

1. Cabinet drawer interlock apparatus for preventing opening of further drawers after any one cabinet drawer has been open, comprising:

separate actuator means affixed to each drawer outer surface;

a plurality of locking bars, one for each drawer, arranged in end-to-end contacting relation, said locking bars being mounted to a cabinet inside surface and capable of individual relative movement, each said locking bar including, a unitary rod extending along a surface facing the adjacent drawer and terminating short of each locking bar end, said rod having a slot therein; and separate locking means for each drawer mounted on each locking bar including a rotor having a V-shaped sprocket on one surface and first and second pawl means on another surface, said V-shaped sprocket engaged with the actuator when the said drawer is closed into the cabinet, and said first pawl means being lockingly positioned between the opposed ends of rods on adjacent locking bars and said second pawl means being positioned within the rod slot when the said drawer is open which moves the remaining locking bars an amount sufficient to misalign the remaining rotor pawls with the respective opposed ends of rods on adjacent locking bars and slots in said rods.

2. Cabinet drawer interlock apparatus as in claim 1, in which the rotor, V-shaped sprocket, first and second pawl means are unitarily related.

3. Cabinet drawer interlock apparatus as in claim 1, in which the spacer means are spring-loaded for resiliently urging the locking bars toward the end contacting relationship.

4. Cabinet drawer interlock apparatus as in claim 1, in which the first and second pawl means each include a limit stop projection for positively positioning said pawl with respect to the locking bar rods.

5. Cabinet drawer interlock apparatus as in claim 1, in which the rotor includes a first diameter part concentrically and unitarily mounted on a second larger diameter part, said parts being separated by a circumferential groove; and a pair of identical housing parts are fitted onto opposite sides of the unitary first and second diameter parts enabling rotation of said first and second diameter parts with respect to said housing parts.

6. Cabinet drawer interlock apparatus as in claim 1, in which each pawl means includes a curved surface for contacting the locking bar rods.

7. Cabinet drawer interlock apparatus as in claim 1, in which each actuator means has parts that fit within a recess in a V-shaped sprocket when the associated drawer is closed into the cabinet, which actuator means parts rotate the sprocket and rotor on the said drawer being opened.

8. Cabinet drawer interlock apparatus as in claim 1, in which there are further provided cabinet locking means that contact the end of the outer end of the uppermost locking bar preventing separation of the locking bars from one another when in the locking mode.

9. Cabinet drawer interlock apparatus as in claim 1, in which each locking bar includes an elongated contact plate with a rod affixed to a major surface of the plate and the opposite ends of the rod being beveled and terminating spaced from a plate edge.

10. Cabinet drawer interlock apparatus as in claim 9, in which the slot in the rod is closely adjacent what is its lower end in assembly and has a larger opening on a side via which the second pawl enters the slot.

* * * * *